US012196471B2

(12) United States Patent
Malin

(10) Patent No.: US 12,196,471 B2
(45) Date of Patent: Jan. 14, 2025

(54) HIGH-EFFICIENCY LOW-TEMPERATURE STORAGE DEVICE

(71) Applicant: LICONIC AG, Mauren (LI)

(72) Inventor: Cosmas Malin, Mauren (LI)

(73) Assignee: LICONIC AG, Mauren (LI)

( * ) Notice: Subject to any disclaimer, the term of this patent is extended or adjusted under 35 U.S.C. 154(b) by 256 days.

(21) Appl. No.: 17/773,338

(22) PCT Filed: Oct. 12, 2020

(86) PCT No.: PCT/EP2020/078612
§ 371 (c)(1),
(2) Date: Apr. 29, 2022

(87) PCT Pub. No.: WO2021/083648
PCT Pub. Date: May 6, 2021

(65) Prior Publication Data

US 2022/0381484 A1 Dec. 1, 2022

(30) Foreign Application Priority Data

Oct. 30, 2019 (CH) ..... 01375/19

(51) Int. Cl.
*F25B 7/00* (2006.01)
*F25D 13/04* (2006.01)
(Continued)

(52) U.S. Cl.
CPC ..... *F25B 7/00* (2013.01); *F25D 13/04* (2013.01); *F25D 25/04* (2013.01); *F25B 9/004* (2013.01)

(58) Field of Classification Search
CPC ..... F25D 13/04; F25D 25/04; F25D 11/04; F25B 7/00; F25B 9/004; F25B 19/005;
(Continued)

(56) References Cited

U.S. PATENT DOCUMENTS 4,030,899 A * 6/1977 Van Litsenburg ..... F25B 9/00 62/610
4,030,900 A 6/1977 Van Litsenburg
(Continued)

FOREIGN PATENT DOCUMENTS

AU 2018413755 10/2019
CH 708 425 2/2015
(Continued)

OTHER PUBLICATIONS

CH-708425-A2 Translation (Year: 2015).*
(Continued)

*Primary Examiner* — David J Teitelbaum
(74) *Attorney, Agent, or Firm* — GREENBLUM & BERNSTEIN, P.L.C.

(57) ABSTRACT

The storage device is adapted to store a plurality of objects, such as sample tube holders, at several low temperatures, e.g., at −80° C. and at −110° C. The storage device includes a storage chamber with a plurality of storage cassettes arranged in its bottom section. A cassette lift in its top section can be used to lift individual storage cassettes up and to move them to an access opening, where the contents of the storage cassette can be accessed. The bottom section is divided into several, concentric storage zones, with the innermost, first storage zone being colder than the outer, second storage zone. A first insulating wall separates the two storage zones. This design reduces the thermal losses of the storage device. A refrigerant circuit with a non-inflammable cryo-liquid is provided for carrying off heat from the first storage zone.

21 Claims, 7 Drawing Sheets

(51) Int. Cl.
*F25D 25/04* (2006.01)
*F25B 9/00* (2006.01)

(58) Field of Classification Search
CPC ..... B01L 7/52; B01L 7/525; F17C 2270/02; A01N 1/0252
See application file for complete search history.

(56) References Cited

U.S. PATENT DOCUMENTS

| | | | | |
|---|---|---|---|---|
| 4,599,871 | A * | 7/1986 | Fredrixon | F25D 13/04 62/378 |
| 5,327,731 | A * | 7/1994 | Markiewicz | F25D 13/04 454/231 |
| 5,600,966 | A * | 2/1997 | Valence | F25D 11/04 312/401 |
| 6,167,710 | B1 | 1/2001 | Cosman | |
| 2003/0233842 | A1 | 12/2003 | Junca et al. | |
| 2006/0156753 | A1* | 7/2006 | Fuhr | A01N 1/0252 62/78 |
| 2007/0169503 | A1 | 7/2007 | Kikuchi et al. | |
| 2009/0026905 | A1 | 1/2009 | Malin | |
| 2009/0188272 | A1* | 7/2009 | Cloutier | F25D 25/04 62/378 |
| 2010/0183408 | A1* | 7/2010 | Malin | B01L 7/50 414/222.01 |
| 2010/0223934 | A1* | 9/2010 | McCormick | F25B 9/145 62/45.1 |
| 2010/0313596 | A1 | 12/2010 | Kikuchi et al. | |
| 2013/0255283 | A1* | 10/2013 | Berchowitz | G01N 1/42 62/449 |
| 2014/0000307 | A1 | 1/2014 | Fuhr et al. | |
| 2014/0166214 | A1 | 6/2014 | Hoffman | |
| 2014/0190977 | A1 | 7/2014 | Malin | |
| 2016/0084564 | A1* | 3/2016 | Malin | G01N 35/04 62/266 |

FOREIGN PATENT DOCUMENTS

| | | | | |
|---|---|---|---|---|
| CH | 708425 | A2 * | 2/2015 | F25D 13/00 |
| CN | 109 084 516 | | 12/2018 | |
| DE | 9304301 | | 6/1993 | |
| DE | 102004035123 | | 2/2009 | |
| EP | 0516093 | | 12/1992 | |
| EP | 1 639 892 | | 3/2006 | |
| EP | 1 783 444 | | 5/2007 | |
| EP | 2743614 | | 6/2014 | |
| EP | 2 998 669 | | 3/2016 | |
| EP | 3 006 867 | | 4/2016 | |
| WO | 2006/074569 | | 7/2006 | |
| WO | 2012/104080 | | 8/2012 | |
| WO | 2019/080967 | | 5/2019 | |

OTHER PUBLICATIONS

Int'l Search Report (PCT/ISA/210) conducted in Int'l Appln. No. PCT/EP2020/078612 (Dec. 21, 2020).
Int'l Written Opinion (PCT/ISA/237) conducted in Int'l Appln. No. PCT/EP2020/078612 (Dec. 21, 2020).
Int'l Prelim. Exam. Report (PCT/IPEA/408) conducted in Int'l Appln. No. PCT/EP2020/078612 (May 17, 2021).
Wikipedia—Air Cycle Machine; https://en.wikipedia.org/w/index.php?title=Air_cycle_machine&oldid=907434807, last edited Jul. 22, 2019.
Wikipedia—Heat Pump; https://en.wikipedia.org/w/index.php?title=Heat_pump&oldid=91670234, last edited Sep. 20, 2019.
Europe Office Action conducted in counterpart Europe Appln. No. 20 790 268.5 (Feb. 26, 2024).

* cited by examiner

HIGH-EFFICIENCY LOW-TEMPERATURE STORAGE DEVICE

TECHNICAL FIELD

The invention relates to a low-temperature storage device for storing a plurality of objects. The invention also relates to a method for operating such a low-temperature storage device.

BACKGROUND ART

Storage devices of this type are e.g. used to store a large number of biological samples at low temperatures. Such samples are e.g. stored in tubes, which in turn are arranged in tube holders. Such tube holders can e.g. be held in storage cassettes.

EP 2998669 describes a low-temperature storage device for storing a plurality of objects. It has a storage chamber with a top and a bottom section. A cassette handler arranged in the top section is able to access storage cassettes in the bottom section and to transport them to a transfer location in a wall of the storage chamber.

A refrigerator device is provided for cooling the storage chamber to low temperature, typically to −80° C. or less.

Systems where the objects are to be stored at cryogenic temperatures below −80° C., in particular below −110° C., such as at −150° C.+/−20° C. (i.e. at a temperature sufficiently low for water to stably form amorphous ice), are typically cooled using liquid nitrogen. Liquid nitrogen has, at ambient pressure, a temperature of −196° C. at its boiling point, which makes it easy to maintain the desired storage temperatures. However, the present systems based on liquid nitrogen cooling are energy inefficient.

DISCLOSURE OF THE INVENTION

The problem to be solved by the present invention is to provide a storage device of this type for storing a plurality of objects that has high energy efficiency.

This problem is solved, in a first aspect of the invention, by the storage device of claim 1. Accordingly, the storage device comprises:

- A storage chamber: This is a refrigerated space for storing the objects. It has a bottom section and a top section.
- A refrigerator device: This device is adapted and structured to cool at least a part of the storage chamber to a temperature below −20° C., typically to at least −80° C. or even lower.
- A plurality of storage cassettes: The storage cassettes are provided for storing the objects, with each storage cassette advantageously having storage locations for a plurality of the objects on top of each other. The storage cassettes are located, during storage, in the bottom section of the storage chamber, and they are accessible from the top section, optionally after removing dividing elements between the top and bottom sections.

Further, the bottom section comprises at least a first and a second storage zone. The second storage zone horizontally surrounds the first storage zone from at least partially, in particular from all sides.

The storage device further comprises a first insulating wall vertically separating the first and said second storage zones.

The refrigerator device is adapted and structured to cool the first storage zone to a first temperature T1 and the second storage zone to a second temperature T2. The first temperature is at least 10° C. below the second temperature. The wording that the second storage zone "surrounds" the first storage zone "at least partially, in particular from all sides" is to be understood as follows: The second storage zone is arranged at least along a first side of the first storage zone. Advantageously, it is arranged along a first and a second side of the first storage zone, with the first and second side being adjacent to each other and extending transversally, in particular perpendicularly, to each other. Even more advantageously, it is also arranged along a third side of the first storage zone, with the third side also being adjacent to the first side and extending transversally, in particular perpendicularly, to the first side.

In a most advantageous embodiment, the second storage zone horizontally surrounds the first storage zone from all sides. In other words, there is a more or less concentric or layer-like design of storage zones in storage chamber, with the colder first storage zone being horizontally completely surrounded by the warmer second storage zone.

The claimed design greatly reduces the flow of heat into the first storage zone, thereby increasing the energy efficiency of the storage device and improving the temperature homogeneity within at least part of the zones.

Advantageously, the first insulating wall is, when seen from above, arranged in a regular polygon or a circle, in particular in a square. This class of shapes reduces the ratio between vertical surface and volume of the first zone.

The storage device can further comprise an automated cassette handler arranged in the top section, with the cassettes being accessible by the cassette handler. This allows to automatically access individual cassettes in the bottom section.

In particular, each storage cassette can comprise a plurality of storage locations above each other. Each such storage location may e.g. comprise one or more shelf members for vertically supporting one of the objects to be stored.

In that case, the storage device advantageously comprises a transfer station in a wall of the storage chamber. The transfer station comprises a transfer opening for transferring laboratory objects between the interior and the exterior of the storage chamber. In order to minimize energy loss and gas transfer through the transfer opening, the transfer opening has a height of less than three times the height of one of the storage locations, in particular of less than twice the height of one of the storage locations. Such a small-sized transfer opening also reduces the risk of erroneously accessing a wrong storage location.

For automated access, the cassette handler can adapted to vertically displace a storage cassette in the transfer station. In this way, it can position each of its storage locations next to the transfer opening.

In a second aspect, the invention relates to a low-temperature storage device for storing a plurality of objects, for example but not necessarily as described above, said device comprising:

- A storage chamber: This is a refrigerated space for storing the objects. It has at least a first storage zone.
- A refrigerator device: This device is adapted and structured to cool the first storage zone to a temperature below −80° C., in particular below −110° C., in particular below −110° C., such as to −150° C.+/−20° C. It comprises a first storage-cooling heat exchanger arranged at said first zone for cooling it.

Further, the refrigerator device comprises a refrigerant circuit conveying a non-inflammable cryo-liquid through the first storage-cooling heat exchanger. In this context, a "refrigerant circuit" is a closed circuit formed by ducts where, in operation, the cryo-liquid is in its liquid, sub-critical state over at least part of the circuit.

The term "cryo-liquid" refers to a non-inflammable liquid that is in its liquid state along at least part of the refrigerant circuit.

In this aspect, the invention also relates to a method for operating such a low-temperature storage device comprising the step of circulating the non-inflammable cryo-liquid through at least part of the liquid refrigerant circuit, advantageously with the cryo-liquid being liquid at least in the coldest part of the refrigerant circuit.

This second aspect of the invention is based on the understanding that using a non-inflammable cryo-liquid for transferring heat between the storage zone and the rest of the refrigerator device provides for improved safety because the storage zone is poorly aired.

Advantageously, the cryo-liquid is argon or nitrogen. These materials are not only non-inflammable, but non-toxic, too. In their liquid state, they can transfer a large amount of energy per volume in an efficient manner.

Further, the use of the refrigerant circuit obviates the need for cooling by directly filling liquid nitrogen delivered in vessels into the storage zone. Hence, the technique is based on generating the cooling where it is needed and not at a remote liquid nitrogen generation plant. No transport of liquid nitrogen vessels between sites is needed. Further, since the cooling is to the desired cooling temperature only, e.g. to −150° C.+/−20° C., refrigeration can operate more efficiently as compared to liquefying nitrogen, which requires temperatures below −196° C. at normal pressure.

Also, one kilogram of liquid nitrogen has no more than 56 Wh of cooling energy. Hence, substantial amounts of liquid nitrogen are required for largescale storage, and the cold parts of the storage must be highly insulated.

Using heat-pump-based cooling units as an on-site refrigerator device comes with the disadvantage that suitable pump liquids at cryogenic temperatures are typically flammable and/or toxic, and, for safety reasons, they are therefore poorly suited to cool a closed, well-insulated storage zone. However, combining them with the refrigerant circuit of the present invention allows to keep the heat pump liquid away from the storage zone.

Hence, in one embodiment, the refrigerator device comprises a heat pump having an evaporator, wherein the refrigerant circuit is thermally coupled to the evaporator.

An on-site refrigerator device may also comprise an air cycle machine, which is defined as a cooling device with an, advantageously closed, air cycle. In this cycle, air is first compressed in a compression turbine, then it is cooled in at least one hot-side heat exchanger, whereupon it is expanded in an expansion turbine. Finally, it is fed through at least one cold-side heat exchanger and fed back to the compression turbine. During the whole cycle, the air remains in its gaseous state.

This type of refrigeration device requires a large volume flow of air. Hence, they it is poorly suited for cooling storage devices where samples should be held in a tranquil, clean environment. This problem can be solved by coupling the cold-side heat exchanger to the refrigerant circuit mentioned above.

Hence, in a second embodiment, the refrigerator device comprises an air cycle machine having a closed air circuit with a compression turbine, a hot-side heat exchanger, an expansion turbine, and a cold-side heat exchanger. The refrigerant circuit is thermally coupled to the second heat exchanger. In operation, air is cycled (in that order) through the compression turbine, the hot side exchanger(s), the expansion turbine, and the cold-side heat exchanger(s). Thus, the cold-side heat exchanger can extract heat from the refrigerant circuit.

The storage device of both aspects of the invention is advantageously used for storing laboratory samples, such as biological or chemical samples.

Other advantageous embodiments are listed in the dependent claims as well as in the description below.

BRIEF DESCRIPTION OF THE DRAWINGS

The invention will be better understood and objects other than those set forth above will become apparent from the following detailed description thereof. Such description makes reference to the annexed drawings, wherein.

MODES FOR CARRYING OUT THE INVENTION

Definitions

A "low-temperature storage device" is a storage device adapted to store objects at temperatures below 0° C., in particular below −20° C., advantageously below −60° C.

A "heat pump" moves thermal energy in the opposite direction of spontaneous heat transfer by absorbing heat from a cold space and releasing it to a warmer one. Advantageously, a heat pump is a device having a condenser, an expansion valve, an evaporator and a compressor, with the compressor pumping a fluid to the condenser (which is heated), through the expansion valve, through the evaporator (which is cooled), and back to the compressor.

In the present context, heat pumps are used for cooling purposes.

Figure 1:
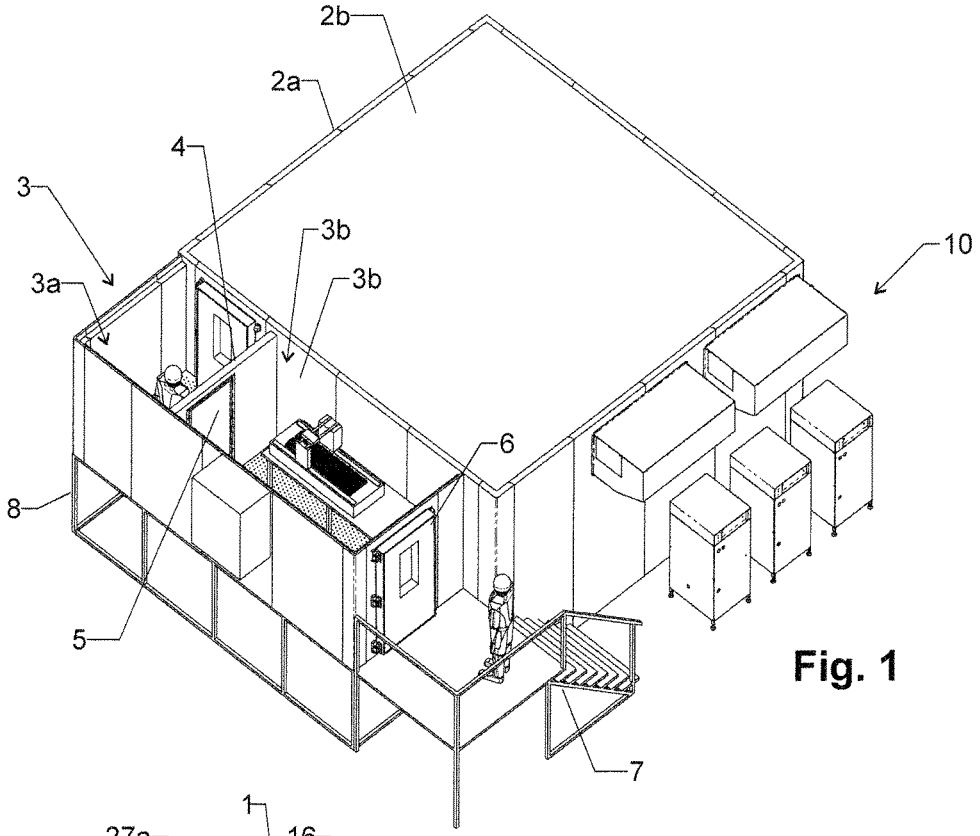
FIG. 1 shows a view of a first embodiment of a storage device, with the ceiling of the transfer chamber removed.
Figure 2:
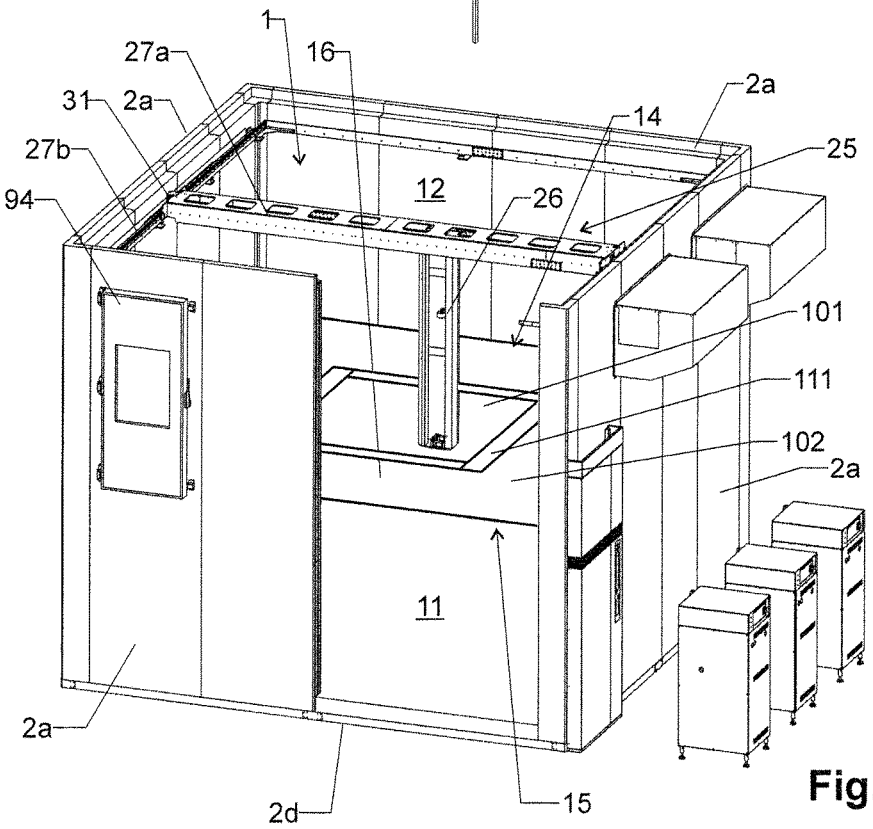
FIG. 2 shows a device similar to the device of FIG. 1 without the transfer chamber and with some of the walls of the storage chamber removed.

Overview:

An embodiment of a storage device is shown in FIGS. 1 and 2. The basic set-up of the storage device corresponds to the one disclosed in EP 2 998 669.

The storage device comprises a storage chamber 1 enclosed by vertical insulating side walls 2*a*, an insulating ceiling 2*b* and an insulating floor 2*d*.

A transfer chamber 3 (FIG. 1) may be located adjacent to storage chamber 1 and shares at least one of the insulating side walls 2*a* with storage chamber 1. In the embodiment of FIG. 1, transfer chamber 3 is divided into two sub-chambers 3*a*, 3*b* with a separating wall 4 having a lock door 5 arranged between them, but transfer chamber 3 can also be a single chamber.

A door 6 provides user access to transfer chamber 3. In the embodiment of FIG. 1, stairs 7 lead up to door 6 because transfer chamber 3 is above the level of bottom wall 2*d* of the device. For the same reason, transfer chamber 3 is supported by struts 8 at its bottom side.

A refrigerator device 10 is provided to cool storage chamber 1 to a storage temperature below 0° C., in particular below −20° C., and in the second aspect of the device below −80° C. Details of the temperatures within storage chamber 1 follow below.

Refrigerator device 10 also cools transfer chamber 3 to a transfer temperature below 0° C., in particular to approximately −20° C.

Advantageously, the air in transfer chamber 3 is cooled and dried such that it has a low dew point, in particular below −30° C.

First Embodiment

The storage chamber 1 shown here is of cuboid shape. As best seen in FIG. 2, it is divided into a bottom section 11 and a top section 12. Top section 12 comprises typically 50-70% of the volume of storage chamber 1, and bottom section lithe rest.

Top section 12 is located vertically above bottom section 11.

Bottom section 11 holds a cassette store 14 formed by a grid 15 located at the top of bottom section 11. Grid 15 forms an array of rectangular apertures 16. Each rectangular aperture 16 forms a cassette location for receiving a storage cassette.

Figure 5:
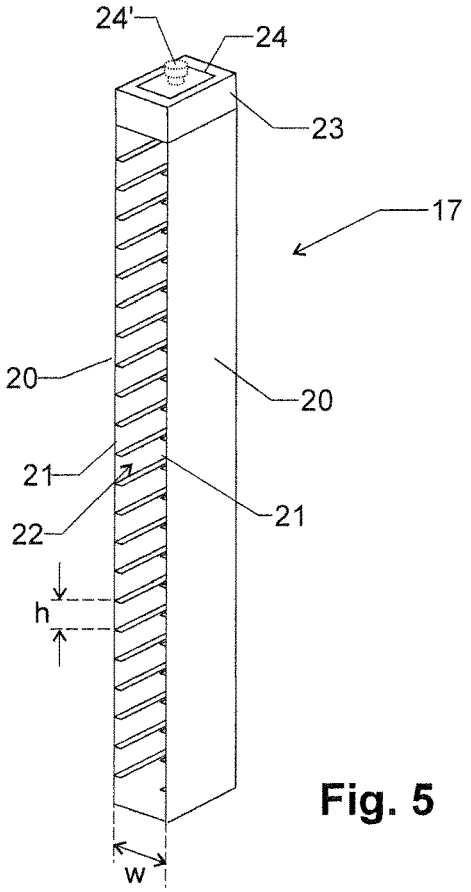
FIG. 5 shows a single storage cassette.

An example of a storage cassette 17 is shown in FIG. 5. It comprises two vertical sidewalls 20, with ledges 21 formed thereon. The ledges 21 form a plurality of storage locations 22 above each other for receiving the objects to be stored. At its top end, the storage cassette 17 comprises an insulating head section 23. The head sections 23 of all storage cassettes 17 inserted into cassette store 14 form an insulating wall between bottom section 11 and top section 12 of storage chamber 1, thereby helping to maintain a more constant temperature in bottom section 11 where most of the objects are stored.

A metal plate 24 or a mechanical coupling member 24' (shown in dotted lines) is located at the top of each storage cassette 17. It is used for gripping the storage cassettes as described in EP 2998669.

The individual cassette locations or apertures 16 in cassette store 14 have a size fitting the footprint of the storage cassettes 17 to be received. There may be differently shaped apertures 16 to receive differently shaped storage cassettes, such as cassettes having the SBS footprint of 134×86 mm and/or cassettes having a "cryobox" square footprint of 137×137 mm.

Figure 3:
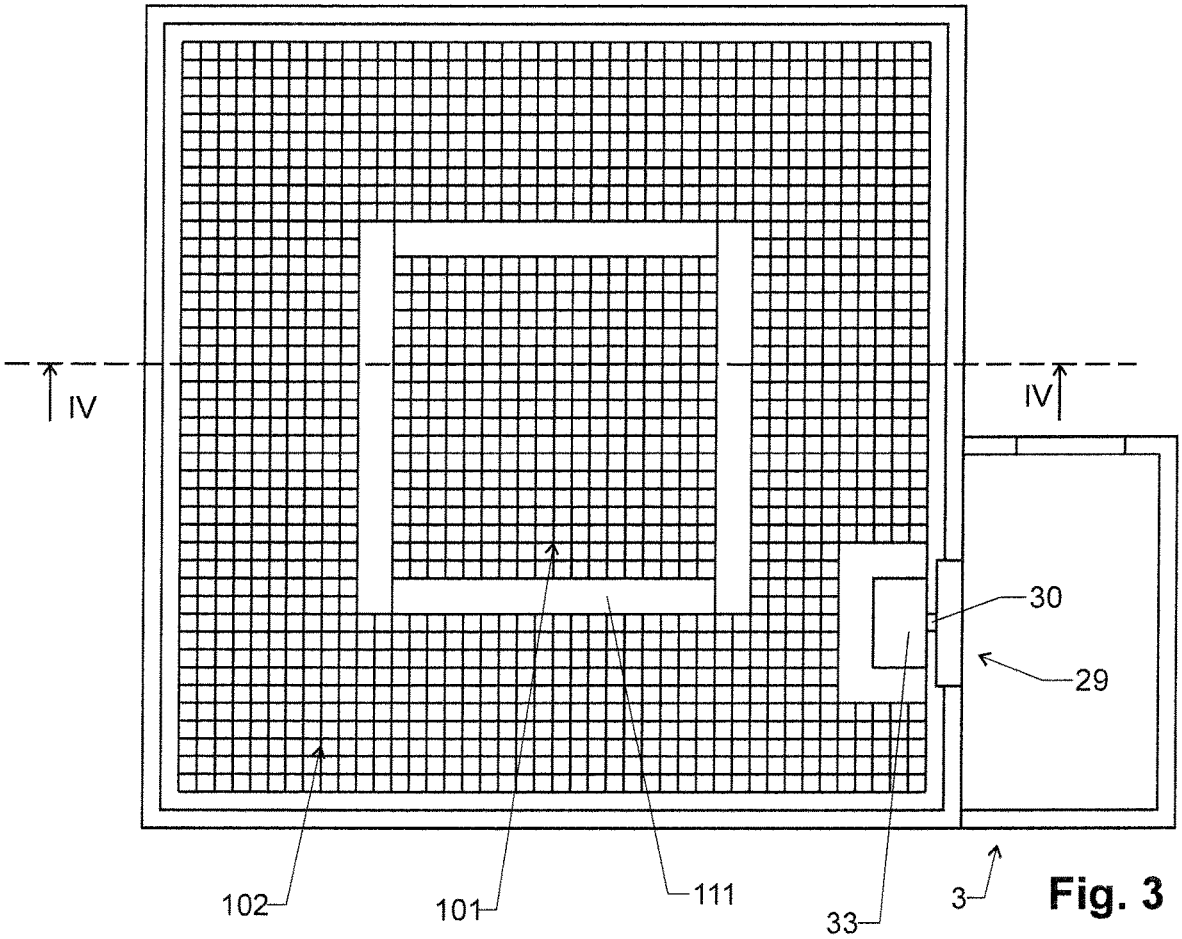
FIG. 3 shows a top view of the bottom section of a storage device.
Figure 4:
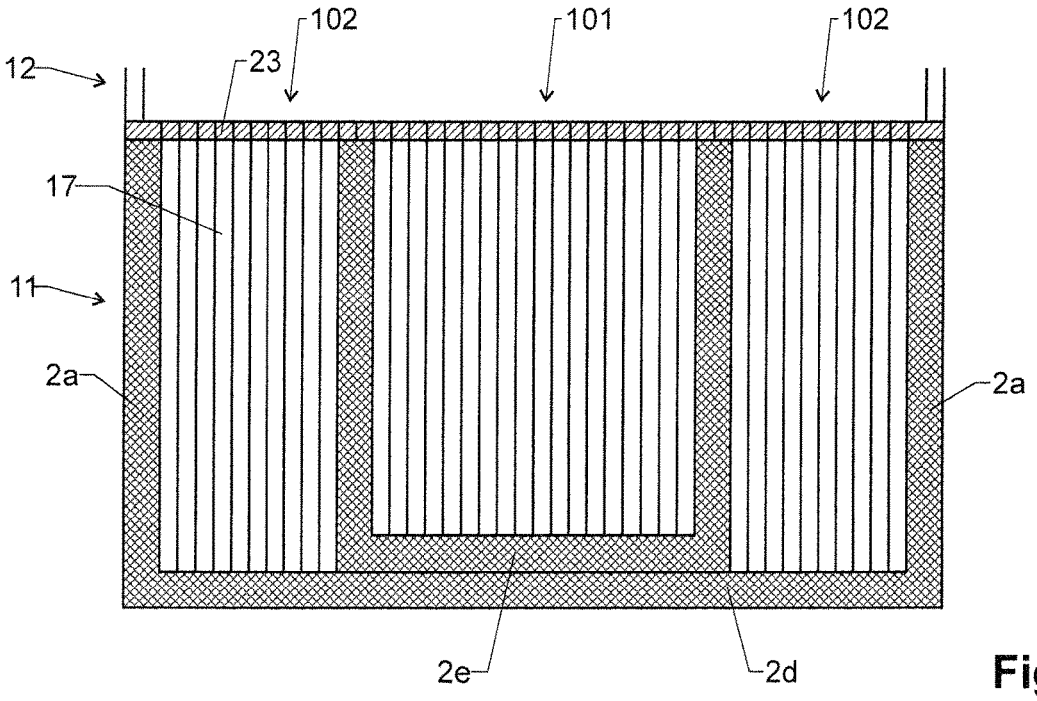
FIG. 4 is a sectional view along line IV-IV of FIG. 3.

As best seen in FIGS. 3 and 4, bottom section 11 is divided into several storage zones. In the embodiment of FIGS. 2 and 3, there is a first storage zone 101 surrounded by a second storage zone 102.

A first insulating wall 111 separates first storage zone 101 from second storage zone 102.

Second storage zone 102 surrounds first storage zone 101 in all horizontal directions. Insulating wall 111 is arranged vertically between them.

As explained above, the temperature T1 in first storage zone 101 is lower than the temperature T2 in second storage zone 102.

For example, the temperature T1 in first storage zone 101 is advantageously below −80° C. In particular, it is smaller than −110° C., in particular smaller than the glass transition temperature of water, i.e. smaller than −130° C.

The temperature T2 in second storage zone 101 is advantageously below −60° C., in particular between −100° C. and −60° C. Other temperature regimes are possible. However, the first temperature T1 is advantageously at least 10° C. below second temperature T2.

As described above, this design reduces the flow of heat from the environment into first storage zone 101 and therefore makes the storage device more energy efficient.

As shown in FIG. 3, when seen from above, first insulating wall 111 is arranged in a square, which minimizes (for a four-fold symmetry) the surface to volume ratio. As mentioned above, any other regular polygon shape or a circle can also be used to optimize that ratio.

FIG. 4 shows that second storage zone 102 has a bottom insulation 2*d*. First storage zone 101 has a bottom insulation 2*e* of its own, sitting on top of bottom insulation 2*d*. Thus, the total bottom insulation below first zone 101 is thicker than below second zone 102.

Hence, if the top of bottom section 11 is to be at the same height over first and second zone 101, 102, longer storage cassettes 17 can be used in second zone 102 in order to fully exploit the available space.

Cassette Handler:

As best seen in FIG. 2, an automated cassette handler 25 is located in top section 12 of storage chamber 1. It comprises a cassette lift 26 adapted to move an individual storage cassette 17 between its cassette location in cassette store 15 and top section 12. Further, cassette handler 25 comprises a cassette holder, which is advantageously formed by cassette lift 26, for holding a raised cassette in top section 12 of storage chamber 1.

Figure 7:
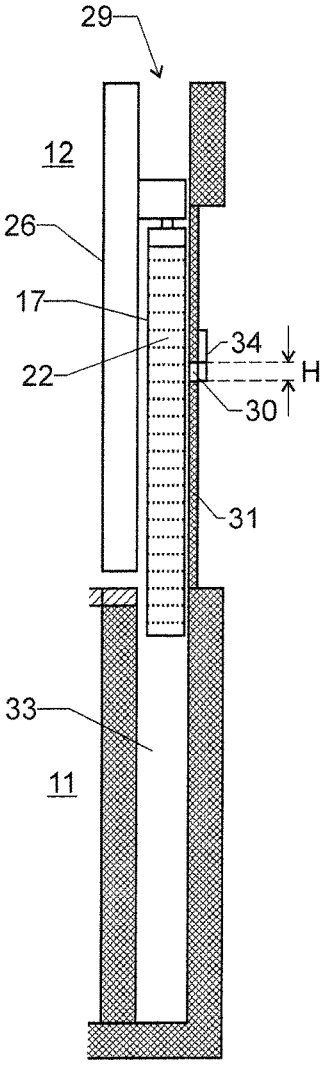
FIG. 7 is a sectional view through the storage device at the location of the access opening.
Figure 6:
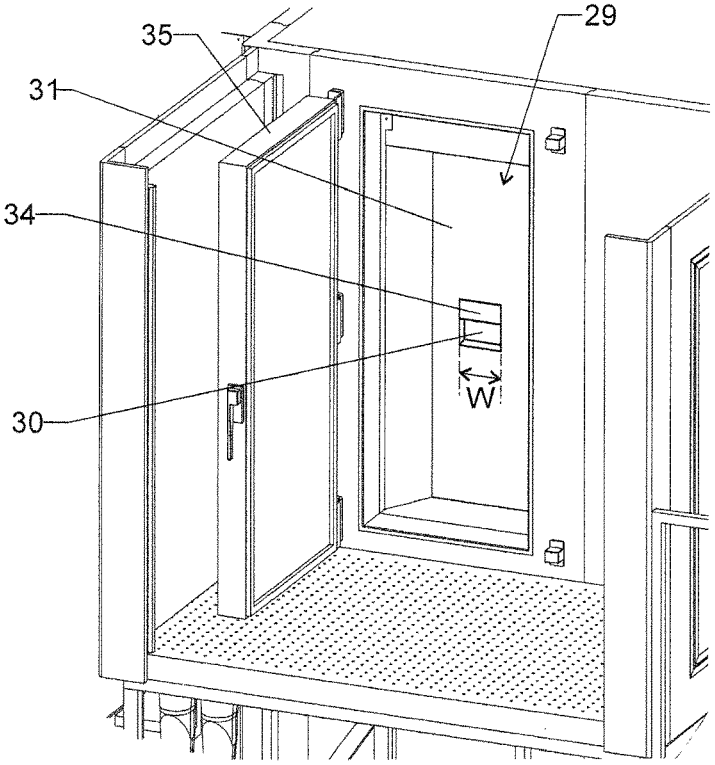
FIG. 6 shows the access opening and its door.

Cassette lift 26, or at least the cassette holder, is arranged on a transport mechanism 27*a*, 27*b*, which is adapted to horizontally displace the cassette holder with a raised cassette, between a position where the raised cassette is vertically above its cassette location to a transfer station 29 having a transfer opening 30 (see FIGS. 6 and 7).

In order to provide enough room for an upright storage cassette 17 as well as the overhead required by cassette handler 25, top section 12 of storage chamber 1 is advantageously somewhat higher than bottom section 11.

Transport mechanism 27*a*, 27*b* comprises a horizontal beam 27*a* spanning storage chamber 1 and being held at opposite ends by rails 27*b*. Beam 27*a* is located at the top of top section 12. Cassette lift 26 is suspended from beam 27*a*. A displacement drive is provided for horizontally displacing beam 27*a* along the rails 27*b*, and also for horizontally displacing cassette lift 26 along beam 27*a*.

The design of cassette lift 26 can e.g. correspond to the one shown in EP 2998669 as described in reference to FIGS. 5 and 9-13 of that document.

Transfer Station:

Transfer station 29 is shown in FIGS. 6 and 7. It comprises a transfer opening 30 arranged in a vertical side wall 31 of top section 12.

In contrast to the design of EP 2998669, transfer opening 30 has a height H of less than three times the height h of one of the storage locations 22, in particular of less than two times the height of one of the storage locations.

In specific numbers, height H may be less than 50 cm, in particular less than 20 cm.

Further, transfer opening 30 may have a width W of less than two times the width w of the storage locations 22.

Using such a small transfer opening 30 in an otherwise closed wall 30 has the advantage of reducing heat and gas exchange when accessing the stored object. It also reduces the risk of accessing the wrong object.

Since transfer opening 30 has a height much smaller than the total height of a storage cassette 17, cassette handler 26 is programmed to vertically displace cassette 17 in transfer station 29 in order to position any desired storage location 22 next to transfer opening 30.

As is best seen in FIGS. 3 and 7, the storage device can comprise a pit 33 at transfer station 29. Pit 33 is located in bottom section 11 and positioned and sized to receive the bottom end of a storage cassette 17 in transfer station 29, such that all of the cassette's storage locations 22 can be positioned next to transfer opening 30.

Pit 33 is open at its top but it may be insulated against the storage zones.

Transfer opening 30 may be equipped with an automated door 34 for closing in when not used. In addition or alternatively thereto, a manually operatable door 35 may be provided.

Figure 8:
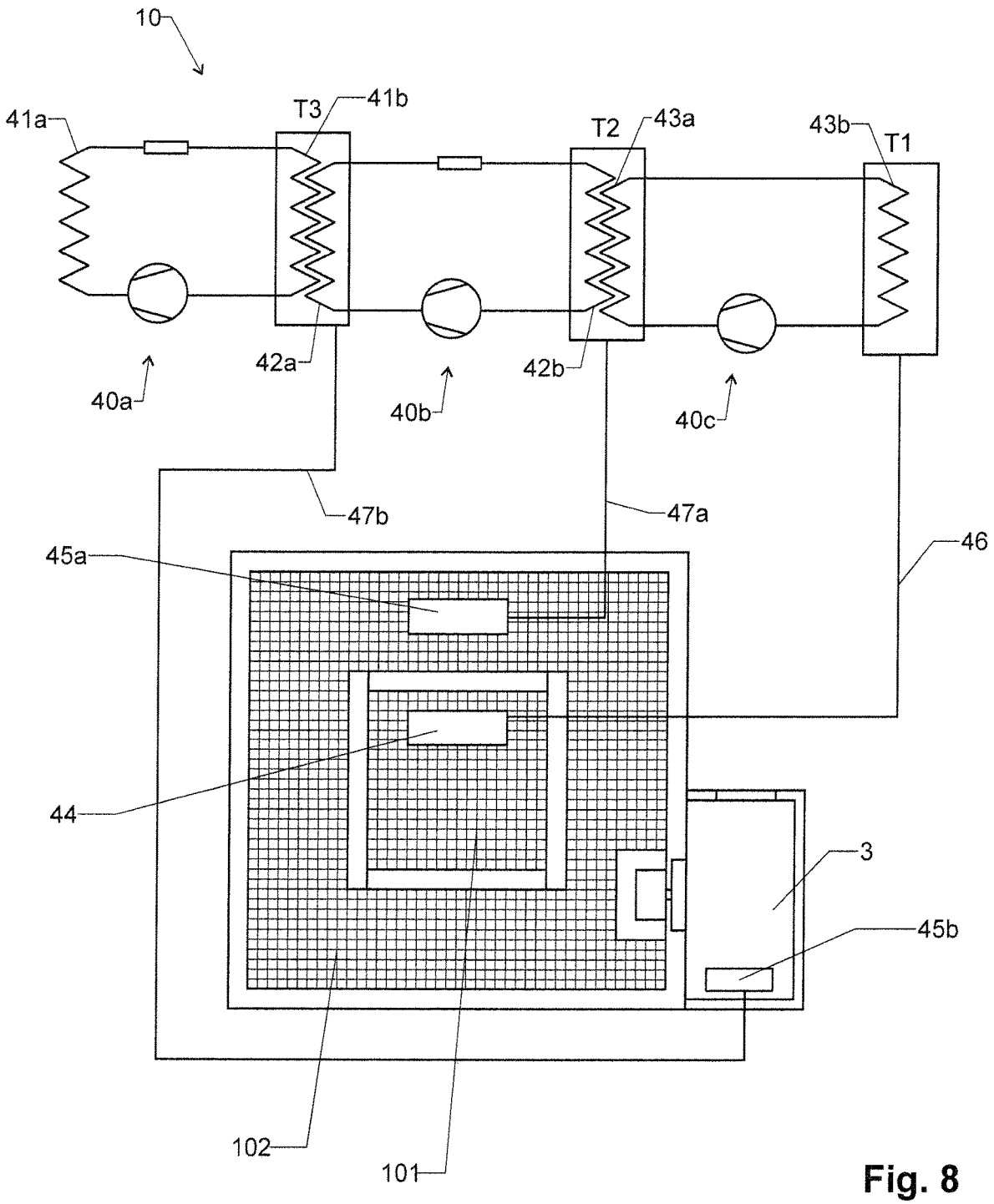
FIG. 8 shows a diagram of a possible arrangement of the heat pumps of the storage device.

Refrigerator Device:

FIG. 8 shows a first embodiment of refrigerator device 10. It is adapted and structured to maintain the temperatures T1 and T2 in the various storage zones of the storage device.

In the shown embodiment, refrigerator device 10 advantageously comprises several heat pumps 40*a*, 40*b*, 40*c* arranged in series, with the condenser 41*a* of the first heat pump 40*a* being cooled e.g. by means of environmental air or cooling water, and its evaporator 41*b* cooling the condenser 42*a* of the next heat pump 40*b* etc., thus generating a series of temperature levels T1 (coldest) through Tn (with n>1 being the number of heat pumps and n=3 in FIG. 8).

The evaporator 43*b* of the last heat pump may be used to cool the first storage zone 101, while the evaporator 42*b* of the second last heat pump may be used to cool the second storage zone 102, etc.

In the embodiment of FIG. 8, a first storage-cooling heat exchanger 44 may be arranged in first storage zone 101, a second storage-cooling heat exchanger 45*a* may be arranged in second storage zone 102, and a third storage-cooling heat exchanger 45*b* may be arranged in transfer chamber 3. Heat transfer devices 46, 47*a*, 47*b* may be provided to transfer heat from the storage-cooling heat exchangers 44, 45*a*, 45*b*, respectively, to the various parts of refrigerator device 10.

The storage-cooling heat exchangers 44, 45*a*, 45*b* can e.g. be designed as liquid-air exchangers or radiators cooling the air in the various parts of the storage device. In addition, they can be used for drying the air, in particular in transfer chamber 3.

The heat transfer device 46 coupling refrigerator device 10 to storage-cooling heat exchanger 44 in first zone is advantageously a refrigerant circuit, i.e. a circuit where a cryo-liquid, in particular argon or nitrogen, is circulated, at least in part in its liquid, sub-critical phase.

More details about heat transfer devices based on the refrigerant circuit are provided below.

Alternatively, liquid gas, in particular liquid nitrogen, may be used to cool one or more of the storage zones 101, 102.

Second Embodiment

As mentioned, the invention is also directed to a storage device having a refrigerant circuit for cooling the first storage zone. This second aspect can be applied to the storage device shown above but also to other types of storage devices, e.g. also to storage devices having non-concentric storage zones or only a single storage zone.

Some further embodiments of the second aspect are described in the following.

Figure 9:
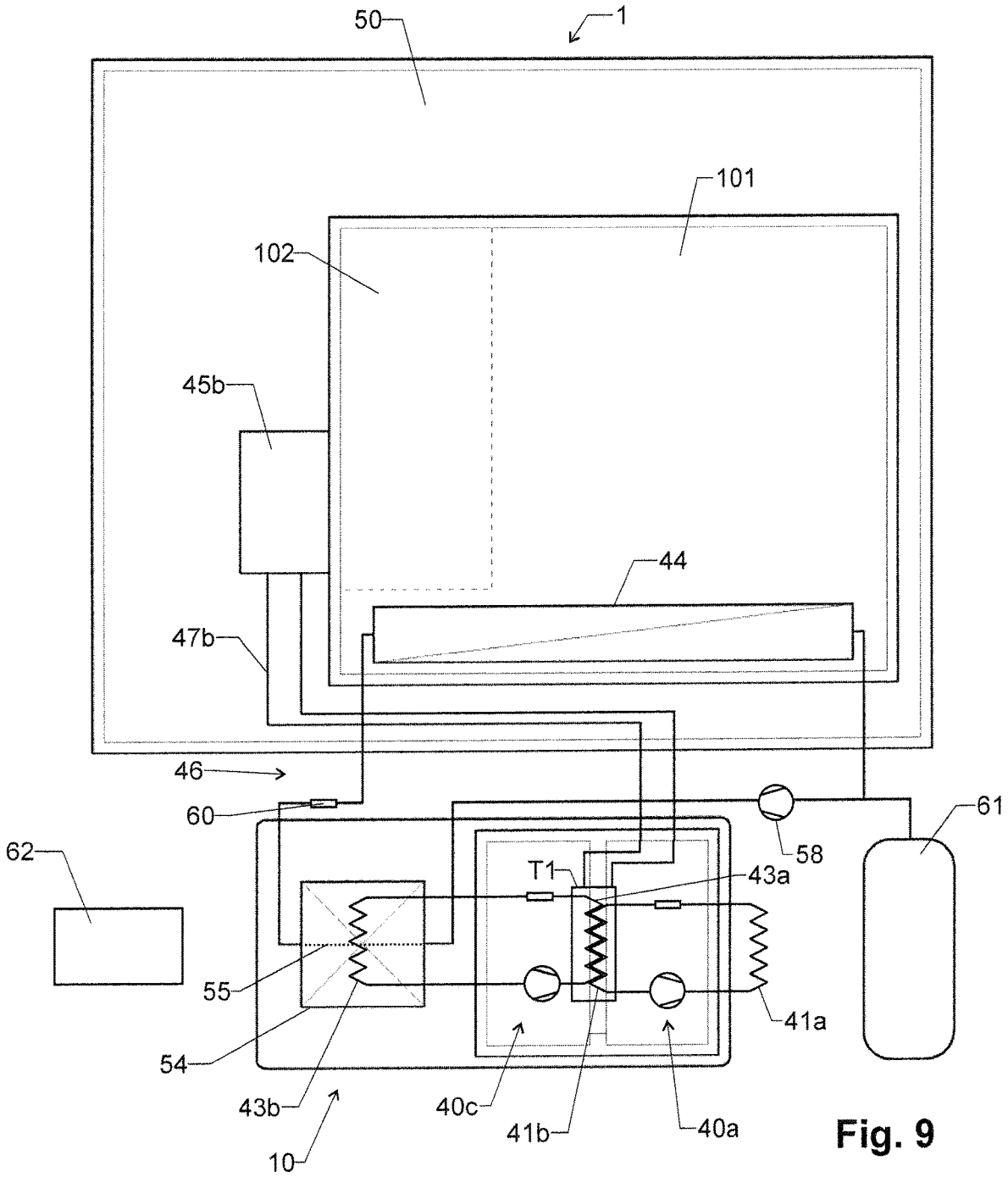
FIG. 9 shows a top view of a second embodiment of a storage device with a refrigerator device.

FIG. 9 shows a second embodiment of a storage device with a storage chamber 1 and a refrigerator device 10.

Storage chamber 1 has an outer region 50 (forming e.g. top section 12 and/or transfer chamber 3 in the embodiments above). Further, it comprises an inner region 52 (forming e.g. bottom section 11 in the embodiments above).

Outer region 50 reduces the transfer of humidity into inner region 52, and it is e.g. maintained at a temperature of −10° C. to −40° C.

Inner region 52 comprises a first storage zone 101 for storing objects at a temperature T1 below −80° C., in particular below −110° C., in particular below −130° C., e.g. at −150° C.+/−20° C.

Inner region 52 may also comprise a second storage zone 102 for storing objects at a higher temperature T2. Second zone 102 may horizontally surround first zone 101, as in the first embodiment, but this is not strictly required in the second aspect of the present technique.

Refrigerator device 10 of the present embodiment comprises several heat pumps 40*a*, 40*c* arranged in series. FIG. 9 shows two of them, but their number may be larger.

Same as in the embodiment of FIG. 8, the evaporator 41*b* of one heat pump 40*a* is used to cool the condenser 43*a* of the next colder heat pump 40*c*.

The evaporator 43*b* of the last (i.e. the coldest) heat pump 40*c* is thermally coupled to a refrigerant circuit 46 by means of a heat exchanger 54.

Refrigerant circuit 46 at least comprises a duct section 55 in heat exchanger 56, which is thermally coupled to evaporator 43*b*, and the storage-cooling heat exchanger 44.

In operation, the cryo-liquid is circulated in refrigerant circuit 46 to transfer heat from storage-cooling heat exchanger 44 to heat exchanger 54, thereby cooling storage zone 101.

In the shown embodiment, refrigerant circuit 46 is designed as a heat pump with a compressor 58 and an expansion valve 60. Storage-cooling heat exchanger 44 forms an evaporator, and duct 55 in heat exchanger 56 forms a condenser for the cryo-liquid. The cryo-liquid is in its sub-critical, liquid state at least on its path from heat exchanger 56 to expander or throttle 60.

Advantageously, an expansion vessel 61 is provided in refrigerant circuit 46. It is designed to receive cryo-liquid in case the temperature in the refrigerant circuit is high, e.g. when the storage device is not in operation.

In operation, first heat pump 40*a* may e.g. have a temperature between −10° C. and −40° C. at its cold side, i.e. at its evaporator 41*b*.

Heat exchanger T1 is coupled to a cooling device 45*b* by means of a heat transfer device 47*b*. Heat transfer device 47*b* may e.g. be a liquid circuit with a suitable pump.

Heat exchanger T1 is also coupled to evaporator 43*a* of heat pump 40*c*, which can e.g. use methane (R50), which evaporates at a temperature below −160° C. Methane is advantageous not only because of its low boiling point but also because it can be used as a heat pump fluid over a large temperature difference.

Heat pump 40*c* may e.g. also use ethane or another liquid. Suitable liquids are typically flammable.

Methane and ethane are environmentally friendly. However, flammable liquids should not be used in closed, poorly aired spaces, such as in first storage zone 101. However, refrigerant circuit 46 allows to design the cooling system without ethane or methane entering the storage zone.

In the embodiment of FIG. 9, only two heat pumps 40*a*, 40*c* are arranged in series. There may, however, also be more heat pumps. In that case, further temperature levels may be available for selectively cooling e.g. second storage zone 102 and/or other parts of storage chamber 1.

Instead of or in addition to using a plurality of heat pumps in series, refrigerator device 10 may also comprise a heat pump using mix of several fluids having different boiling points and with liquid/gas separators in order to generate different temperature levels as known to the skilled person.

Third Embodiment

Figure 10:
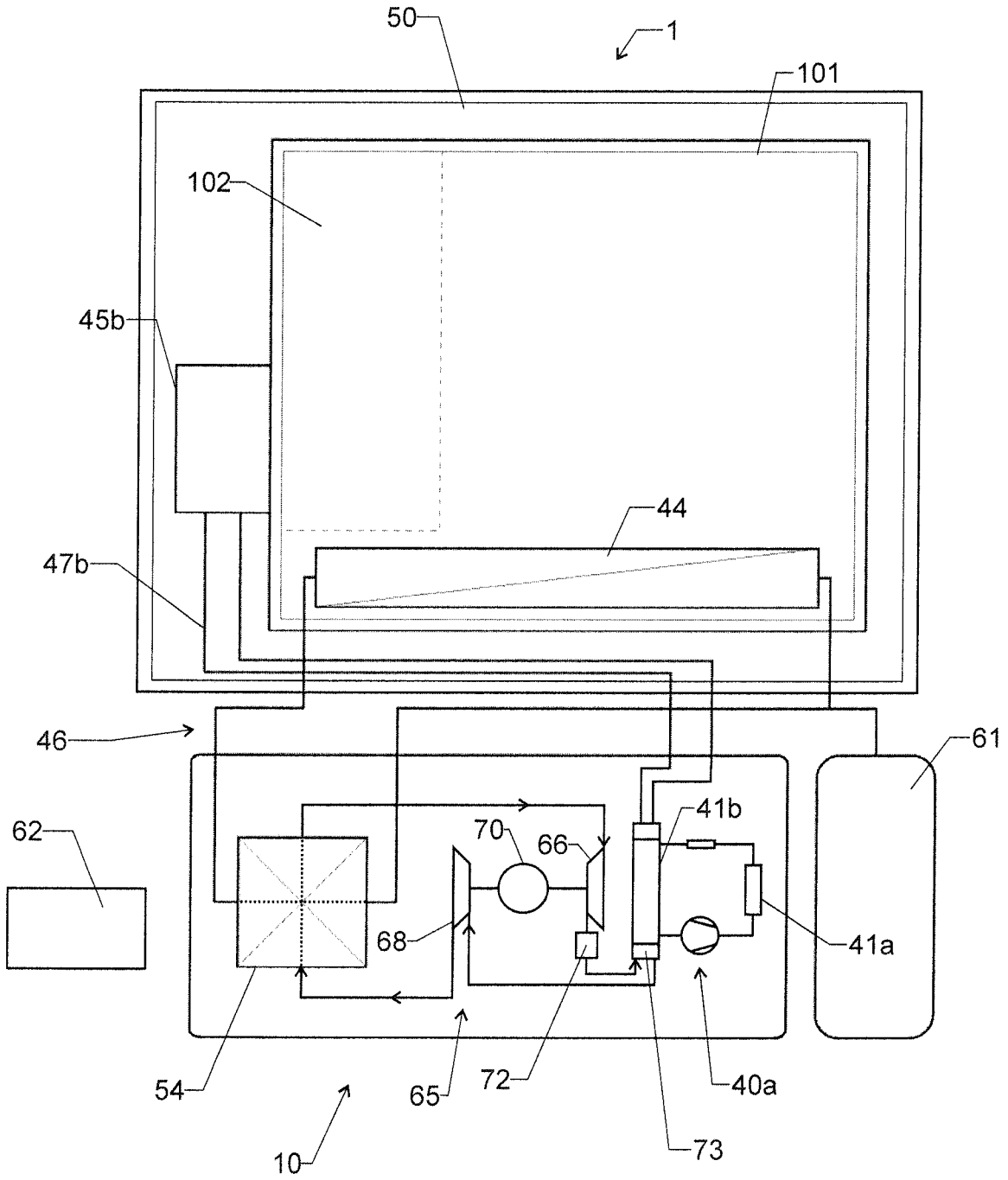
FIG. 10 shows a top view of a third embodiment of a storage device with a refrigerator device.

FIG. 10 shows a storage device similar to the one of FIG. 9. In this embodiment, however, refrigerator device 10 comprises an air cycle machine 65 having a compression turbine 66 and an expansion turbine 68, e.g. driven by a common motor 70. It further comprises one or more hot-side heat exchangers 72, 73 between compression turbine 66 and expansion turbine 68 for cooling the air and at least one cold-side heat exchanger 54 arranged after expansion turbine 68.

Cold-side heat exchanger 54 is again coupled to refrigerant circuit 46.

The hot-side heat exchanger(s) 72, 73 may be cooled e.g. by environmental air and/or water.

Advantageously, though, and as shown in FIG. 10, the air from compression turbine 66 is first guided through first hot-side heat exchanger 72, which is e.g. cooled by environmental air and/or water, and then though second hot-side heat exchanger 73, which is cooled by a separate heat pump 40*a*.

Heat pump 40*a* may comprise condenser 41*a* cooled e.g. by environmental air and/or water and an evaporator 41*b*. Evaporator 41*b* is coupled to second hot-side heat exchanger 73 of air cycle machine 65, which allows to reach lower temperatures at cold-side heat exchanger 54.

In other words, refrigerator device 10 advantageously comprises a first heat pump 40*a* having an evaporator 41*b* thermally coupled to a hot-side heat exchanger 73 of air cycle machine 65.

Advantageously, evaporator 41*b* of heat pump 40*a* is also coupled to at least one heat transfer device 47*a*, 47*b* for cooling a part of storage device 1 to a temperature between −5° C. and −80° C., in particular between −10° C. and −40° C.

In operation, air is compressed by compression turbine 66, cooled in the hot-side heat exchanger(s) 72, 73, and expanded in expansion turbine 68. The cooled air after expansion turbine 68 receives thermal energy in heat exchanger 54, whereupon it returns to compression turbine 66.

As described above, air cycle machine 65 can be used for reaching very low temperatures, e.g. around −150° C.+/−20° C., at heat exchanger 54.

Refrigerant circuit 46 is coupled to heat exchanger 54.

Refrigerant Circuit

As mentioned above, the refrigerant circuit 46 is used to carry heat away from storage zone 101.

As described above, refrigerant circuit 46 can be a heat pump evaporating the cryo-liquid in storage-cooling heat exchanger 44.

Alternatively, the cryo-liquid in refrigerant circuit 46 may be circulated in its subcritical, liquid state by natural convection or by means of a pump, without a phase change taking place.

Advantageously, the temperature in refrigerant circuit 46 is below −80° C., in particular below −110° C., in particular below −130° C. On the other hand, it is advantageously above −180° C.

In particular, the temperature at first storage-cooling heat exchanger 44 in storage zone 101 is at −150° C.+/−20° C.

To keep the cryo-liquid in its liquid state, the pressure in at least part of refrigerant circuit 46 (namely at the parts where the cryo-liquid should be liquid) is advantageously at least 2 bar, in particular at least 5 bar, e.g. 10-30 bar, in particular when using argon or nitrogen as a cryo-liquid. In one embodiment, it is at 15+/−3 bar when operating at a cryo-liquid temperature of −150+/−4° C. In another embodiment, it is at 25+/−3 bar when operating at an cryo-liquid temperature of −140+/−3° C.

The storage device further comprises a control unit 62 (which is shown, by way of example, in FIGS. 9 and 10), which is adapted and structured to operate refrigerator device 10 to maintain the parameters described here during operation of the storage device.

Figure 11:
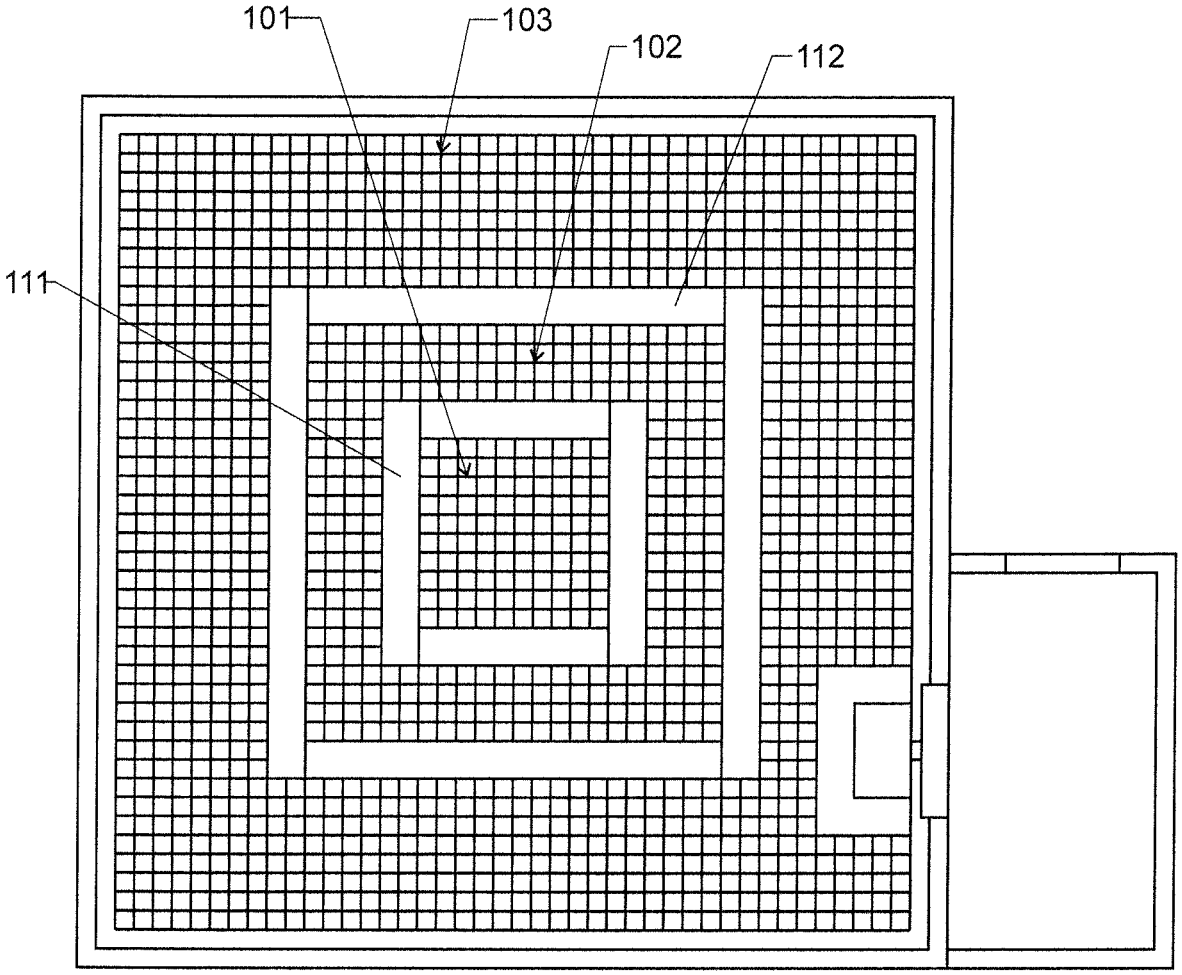
FIG. 11 shows a top view of the bottom section of a storage device with three storage zones.

Notes:

In some of the embodiments of the first aspect described so far, there are two storage zones 101, 102. There may, however, also be more than two storage zones, e.g. at least three storage zones, 101, 102, 103 as shown in FIG. 11. In this case, the third storage zone 103 horizontally surrounds the second storage zone 102, and a second insulating wall 112 vertically separates the second and third storage zones 102, 103.

Refrigerator device 10 may control the third temperature T3 in third storage zone 103 to be higher than the second temperature T2 in second storage zone 102. Advantageously, second temperature T2 is at least 10° C. below third temperature T3.

In the embodiments of the first aspect as described above, second storage zone 102 horizontally surrounds first storage zone 101. Alternatively, and as mentioned, second storage zone 102 may surround first storage zone 101 only partially.

The temperatures and pressures of the refrigerant circuit given above are particularly optimized for using argon as a cryo-liquid, but they can be easily adapted to e.g. nitrogen or another inert gas by using the material's phase diagram.

The storage device can be used to store a vast range of objects, such as chemical or biological samples. The objects may e.g. be tube holders (tube racks) or microtiter-plates, with each tube rack or microtiter-plate being stored in its own storage location 22.

While there are shown and described presently preferred embodiments of the invention, it is to be distinctly understood that the invention is not limited thereto but may be otherwise variously embodied and practiced within the scope of the following claims.

The invention claimed is:

1. A low-temperature storage device for storing a plurality of objects, said device comprising a storage chamber having a bottom section and a top section, a refrigerator device adapted and structured to cool at least a part of said storage chamber to a temperature below −20° C., a plurality of storage cassettes arranged in said bottom section and accessible from said top section, wherein said bottom section comprises a first and a second storage zone, wherein said second storage zone horizontally surrounds said first storage zone at least partially, wherein storage cassettes are arranged in the first and second storage zones, wherein said storage device further comprises a first insulating wall vertically separating the first and the second storage zones, and wherein said refrigerator device is adapted and structured to cool said first storage zone to a first temperature T1 and said second storage zone to a second temperature T2, wherein said first temperature is at least 10° C. below said second temperature T2, an automated cassette handler arranged in said top section, wherein said plurality of storage cassettes in said bottom section are accessible by said automated cassette handler, and wherein each storage cassette of the plurality of storage cassettes comprises a plurality of storage locations above each other, wherein said storage device further comprises a transfer station at a wall in said storage chamber, wherein said transfer station comprises a transfer opening, and wherein said transfer opening has a height of less than three times the height of one of the storage locations, and a pit in said bottom section at said transfer station sized and positioned to receive a bottom end of a storage cassette located at said transfer opening.

2. The storage device of claim 1, wherein the second storage zone is arranged at least along a first and a second side of the first storage zone, with the first and second sides being adjacent to each other and extending transversally to each other, and wherein the second storage zone is also arranged along a third side of the first storage zone, with the third side also being adjacent to the first side and extending transversally to the first side.

3. The storage device of claim 1, wherein the second storage zone horizontally surrounds the first storage zone from all sides.

4. The storage device of claim 1, wherein

T1 <−80° C., and/or

T2 <−60° C.

5. The storage device of claim 1, wherein said first insulating wall is, when seen from above, arranged as a regular polygon or a circle.

6. The storage device of claim 1, further comprising a bottom insulation below said first and said second storage zone, wherein the bottom insulation below the first storage zone is thicker than below the second storage zone.

7. The storage device of claim 1, wherein said bottom section further comprises a third storage zone horizontally surrounding said second storage zone and a second insulating wall vertically separating the second and the third storage zones.

8. The storage device of claim 1, wherein said automated cassette handler is adapted to vertically displace a storage cassette of the plurality of storage cassettes in said transfer station in order to position each of the plurality of storage locations next to the transfer opening.

9. The storage device of claim 1, wherein said transfer opening has a width of less than two times a width of one of the storage locations.

10. A storage device of claim 1, wherein the refrigerator device is adapted and structured to cool said first storage zone to a temperature below −80° C., wherein said refrigerator device comprises a first storage-cooling heat exchanger arranged at said first storage zone, wherein said refrigerator device comprises a refrigerant circuit conveying a non-inflammable cryo-liquid through said first storage-cooling heat exchanger, and wherein the refrigerant circuit is a closed circuit formed by ducts suitable to receive, in operation, the cryo-liquid in a liquid, sub-critical state over at least part of the circuit.

11. The storage device of claim 10, wherein said cryo-liquid is argon or nitrogen.

12. The storage device of claim 10, wherein said refrigerator device comprises a heat pump having an evaporator, wherein said refrigerant circuit is thermally coupled to said evaporator.

13. The storage device of claim 12, wherein said heat pump comprises a flammable liquid.

14. The storage device of claim 12, comprising at least a first and a second heat pump arranged in series, with said first heat pump cooling the second heat pump.

15. The storage device of claim 14, wherein said first heat pump is structured and adapted to cool at least part of said storage chamber.

16. The storage device of claim 10, wherein said refrigerant circuit is a heat pump comprising an evaporator arranged in said first storage zone.

17. A method for operating the low-temperature storage device of claim 10, comprising circulating a cryo-liquid in a liquid state through at least part of said refrigerant circuit.

18. The method of claim 17 comprising maintaining a pressure of at least 2 bar in at least part of said refrigerant circuit.

19. A low-temperature storage device for storing a plurality of objects, said device comprising:

a storage chamber having a bottom section and a top section, a refrigerator device adapted and structured to cool at least a part of said storage chamber to a temperature below −20° C., a plurality of storage cassettes arranged in said bottom section and accessible from said top section, wherein said bottom section comprises a first and a second storage zone, wherein said second storage zone horizontally surrounds said first storage zone at least partially, wherein storage cassettes are arranged in the first and second storage zones, wherein said storage device further comprises a first insulating wall vertically separating the first and the second storage zones, and wherein said refrigerator device is adapted and structured to cool said first storage zone to a first temperature T1 and said second storage zone to a second temperature T2, wherein said first temperature is at least 10° C. below said second temperature T2, wherein the refrigerator device is adapted and structured to cool said first storage zone to a temperature below −80° C., wherein said refrigerator device comprises a first storage-cooling heat exchanger arranged at said first storage zone, wherein said refrigerator device comprises a refrigerant circuit conveying a non-inflammable cryo-liquid through said first storage-cooling heat exchanger, and wherein the refrigerant circuit is a closed circuit formed by ducts suitable to receive, in operation, the cryo-liquid in a liquid, sub-critical state over at least part of the circuit, and wherein said refrigerator device comprises an air cycle machine having a closed air circuit with a compression turbine, at least one hot-side heat exchanger, an expansion turbine, and at least one cold-side heat exchanger, wherein said refrigerant circuit is thermally coupled to said cold-side heat exchanger.

20. The storage device of claim 19 wherein said refrigerator device comprises a first heat pump having an evaporator thermally coupled to at least one of the hot-side heat exchanger(s) of the air cycle machine.

21. The storage device according to claim 19, wherein said second storage zone horizontally surrounds said first storage zone from all sides.

* * * * *